US008509632B2

(12) United States Patent
Tajima

(10) Patent No.: US 8,509,632 B2
(45) Date of Patent: Aug. 13, 2013

(54) IMAGE FORMING APPARATUS

(75) Inventor: Shinichi Tajima, Osaka (JP)

(73) Assignee: Kyocera Mita Corporation (JP)

( * ) Notice: Subject to any disclaimer, the term of this patent is extended or adjusted under 35 U.S.C. 154(b) by 156 days.

(21) Appl. No.: 13/193,695

(22) Filed: Jul. 29, 2011

(65) Prior Publication Data

US 2012/0027435 A1 Feb. 2, 2012

(30) Foreign Application Priority Data

Jul. 30, 2010 (JP) ..... 2010-171991

(51) Int. Cl.
*G03G 15/08* (2006.01)
*G03G 15/00* (2006.01)

(52) U.S. Cl.
USPC ..... 399/30; 399/49

(58) Field of Classification Search
USPC ..... 399/30, 49, 254
See application file for complete search history.

(56) References Cited

U.S. PATENT DOCUMENTS 6,947,677 B2 * 9/2005 Uyama et al. ..... 399/27
7,319,828 B2 * 1/2008 Takesawa et al. ..... 399/27

FOREIGN PATENT DOCUMENTS

JP 2008-58629 3/2008

* cited by examiner

*Primary Examiner* — David Gray
*Assistant Examiner* — Erika J Villaluna
(74) *Attorney, Agent, or Firm* — Gerald E. Hespos; Michael J. Porco; Matthew T. Hespos

(57) ABSTRACT

An image forming apparatus includes a two-component developing devices for each of a plurality of photoreceptors and a motor for the developing device. A transmission can assume a coupled state where the transmission transmits driving force of the motor to the developing device and a separated state where the transmission does not transmit the driving force of the motor to the developing device. A toner agitating mechanism stirs toner inside the developing device. A permeability sensor detects permeability inside the developing device and outputs a signal according to a ratio of the toner to the carrier. A coupling judging section judges that the coupling state exists when a variation of a signal value outputted by the permeability sensor equals or exceeds a predetermined value and judges that the separated state exists when the variation of the signal value outputted by the permeability sensor is lower than the predetermined value.

3 Claims, 8 Drawing Sheets

IMAGE FORMING APPARATUS

BACKGROUND OF THE INVENTION

1. Field of the Invention

The present invention relates to an image forming apparatus and, particularly, to an image forming apparatus that stops driving of a color developing device during black and white mode and drives the color developing device during color mode.

2. Description of the Related Art

Some electrophotographic color image forming apparatus prevent deterioration of a color developing device caused by driving the color developing device when not involved in image formation and deterioration of toner caused by unnecessary agitating of the toner by coupling a color developing device to a drive motor to drive the color developing device only during color mode and separating the color developing device from the drive motor to stop the color developing device during black and white mode. Conventionally, whether a developing device is in a coupled state or a separated state is detected by a position sensor (separation sensor) that detects a position of a driving force transmission mechanism such as a cam which couples/separates the drive motor and the developing device with/from each other.

However, providing the position sensor requires installation space for the position sensor and also increases cost.

SUMMARY OF THE INVENTION

An object of the present invention is to provide an image forming apparatus capable of determining the coupled state and the separated state of a developing device without being provided with a position sensor.

An image forming apparatus according to an aspect of the present invention which achieves the object described above includes: a plurality of photoreceptor members; a two-component system developing device which is provided to correspond to each of the plurality of photoreceptor members, internally houses a developer including a toner and a carrier, and supplies toner to a surface of the photoreceptor to form a toner image; a drive motor which generates a driving force; a driving force transmission mechanism which transmits driving force of the drive motor to each developing device and assumes a coupled state in which the driving force transmission mechanism is coupled to the developing device and transmits driving force of the drive motor to the developing device and a separated state in which the driving force transmission mechanism is separated from the developing device and does not transmit the driving force of the drive motor to the developing device; a toner agitating mechanism which is driven by the driving force from the drive motor when the driving force transmission mechanism is in the coupled state and which stirs the toner inside the developing device; a permeability sensor which detects permeability inside the developing device and outputs a signal according to a ratio of the toner to the carrier; and a coupling judging section which judges that the coupling state exists when a variation of a signal value outputted by the permeability sensor equals or exceeds a predetermined value and judges that the separated state exists when the variation of the signal value outputted by the permeability sensor is lower than the predetermined value.

BRIEF DESCRIPTION OF THE DRAWINGS

FIGS. 4A and 4B are schematic views for explaining coupling/separating of a developing device to/from a drive motor, wherein FIG. 4A shows a coupled state and FIG. 4B shows a separated state.

DETAILED DESCRIPTION OF THE PREFERRED EMBODIMENTS

Figure 1:
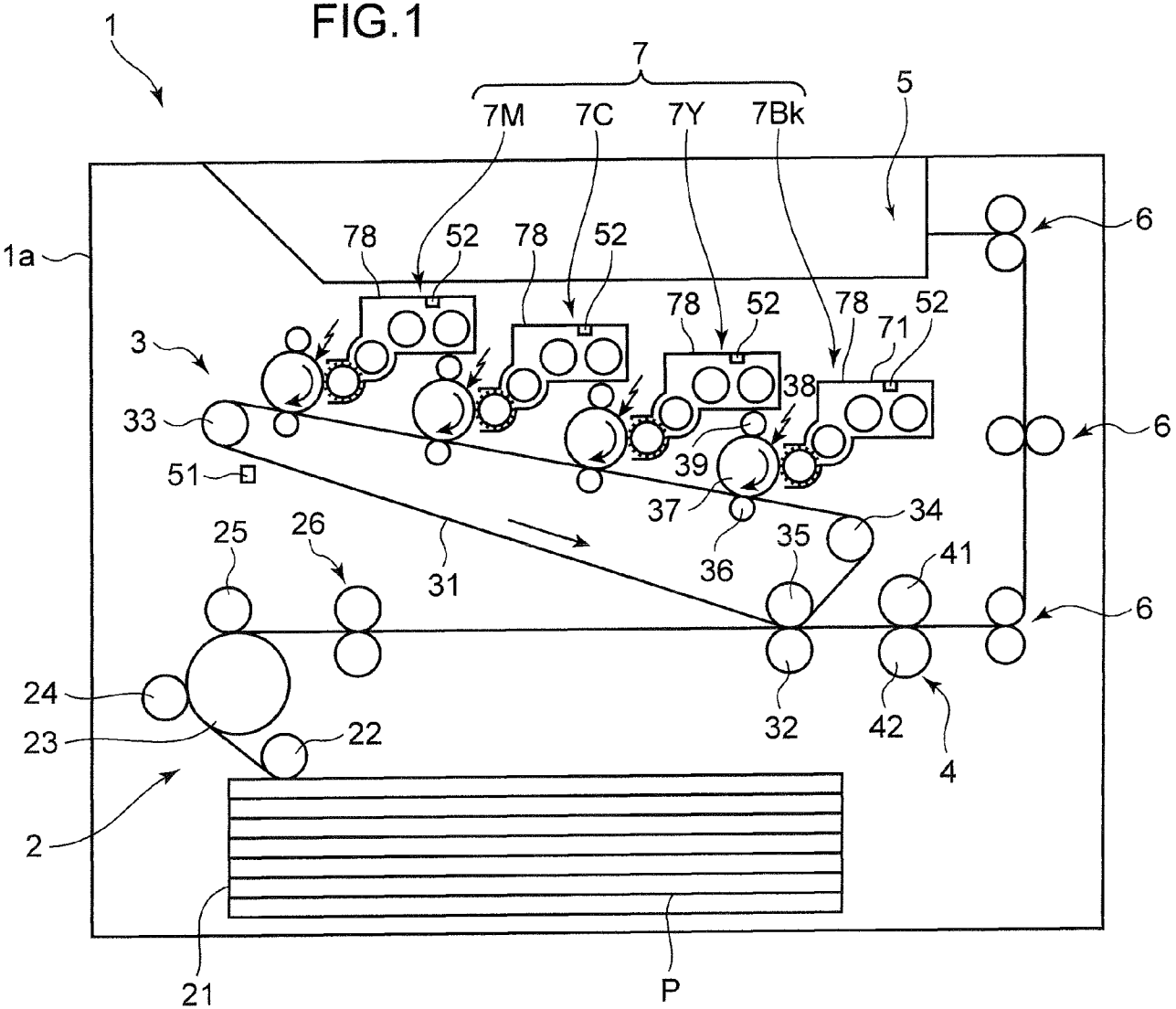
FIG. 1 is a front cross-sectional view showing a structure of an image forming apparatus according to an embodiment of the present invention.

Hereinafter, an embodiment of an image forming apparatus according to the present invention will be described. FIG. 1 is an overall configuration diagram of a color printer 1 that is an example of an image forming apparatus according to the present invention.

As shown in FIG. 1, the color printer 1 includes a box-like apparatus main body 1*a*. Provided inside the apparatus main body 1*a* are: a paper feeding section 2 that feeds sheets of paper P; an image forming section 3 that performs an image forming operation based on image data on a sheet of paper P fed from the paper feeding section 2 while conveying the sheet of paper P; and a fixing section 4 that performs fixing in which a toner image transferred onto the sheet of paper P by the image forming section 3 is fixed onto the sheet of paper P. In addition, a paper ejecting section 5 to which the sheet of paper P subjected to fixing by the fixing section 4 is ejected from inside the apparatus main body 1*a* is provided on an upper face of the apparatus main body 1*a*.

The paper feeding section 2 includes a paper feeding cassette 21, a pick-up roller 22, paper feeding rollers 23, 24, and 25, and a resist roller 26. The paper feeding cassette 21 is insertably and removably provided on the apparatus main body 1*a* and stores the sheets of paper P that have a predetermined size. The pick-up roller 22 is provided at a position above and to the left of the paper feeding cassette 21 as shown in FIG. 1 and feeds out the paper P stored in the paper feeding cassette 21 one by one. The paper feeding rollers 23, 24, and 25 send out the sheet of paper P fed out by the pick-up roller 22 to a paper conveying path. The resist roller 26 temporarily holds the sheet of paper P sent out to the paper conveying path by the paper feeding rollers 23, 24, and 25, and supplies the sheet of paper P to the image forming section 3 at a predetermined timing.

The image forming section 3 includes: a plurality of image forming units 7; an intermediate transfer belt 31 onto which a toner image based on image data transmitted from a computer or the like is primary-transferred by each of the image forming units 7; and a secondary transfer roller 32 for performing secondary transfer of the toner image primary-transferred onto the intermediate transfer belt 31 onto the sheet of paper P sent from the paper feeding cassette 21.

The image forming units 7 include a black (Bk) unit 7Bk, a yellow (Y) unit 7Y, a cyan (C) unit 7C, and a magenta (M) unit 7M provided in parallel from an upstream side (a right-hand side in FIG. 1) to a downstream side. Each of the units 7Bk, 7Y, 7C, and 7M includes a photosensitive drum 37

(photoreceptor member) as an image carrier. The photosensitive drums 37 are arranged to be rotatable in a direction indicated by arrows (clockwise). A charger 39, an exposure device 38, a developing device 71, and a cleaning device, a neutralizer, and the like (not shown) are sequentially arranged around each photosensitive drum 37 along a rotating direction of the photosensitive drum 37.

The charger 39 uniformly charges a circumferential surface of the photosensitive drum 37 rotating in the direction indicated by the arrow. For example, a noncontact discharge corotron charger or scorotron charger, or a contact charging roller or charging brush can be used as the charger 39. The exposure device 38 is a so-called laser scanning unit which irradiates a laser light based on image data inputted from a computer or the like onto the circumferential surface of the photosensitive drum 37 uniformly charged by the charger 39 to form an electrostatic latent image based on the image data on the photosensitive drum 37.

The developing device 71 internally houses a two-component developer including a toner and a carrier, and supplies the toner to the circumferential surface of the photosensitive drum 37 on which the electrostatic latent image is formed to form a toner image based on the image data. The toner image is primary-transferred to the intermediate transfer belt 31. While the toner is used up by the formation of the toner image, the toner is replenished to the developing device from a toner container (not shown) in a timely manner.

Each developing device 71 includes a TC sensor 52 (permeability sensor). The TC sensor 52 detects a ratio (T/C) between the toner and the carrier of the two-component developer housed inside the developing device 71. In other words, the TC sensor 52 detects permeability of the two-component developer from a magnetoresistance value at a developer housing section 78 (refer to FIG. 2), converts the detected permeability into an electrical signal (voltage value), and outputs the electrical signal (voltage value) to a control unit 110, to be described later.

The cleaning device cleans toner particles remaining on the circumferential surface of the photosensitive drum 37 after primary transfer of the toner image onto the intermediate transfer belt 31 is completed. The neutralizer neutralizes the circumferential surface of the photosensitive drum 37 after the primary transfer is completed. The circumferential surface of the photosensitive drum 37 cleaned and neutralized by the cleaning device and the neutralizer is submitted to a new charging process by the charger 39.

The intermediate transfer belt 31 is an endless belt body which is bridged across a plurality of rollers including a drive roller 33, a driven roller 34, a backup roller 35, and a primary transfer roller 36 in a mode in which a surface-side of the intermediate transfer belt 31 abuts circumferential surfaces of the respective photosensitive drums 37. The intermediate transfer belt 31 revolvingly travels in a state of being pressed against the photosensitive drums 37 by the primary transfer roller 36 arranged so as to oppose the respective photosensitive drums 37. The drive roller 33 is rotated by a drive source such as a stepping motor and applies, to the intermediate transfer belt 31, a drive force that enables travel of the intermediate transfer belt 31. The driven roller 34, the backup roller 35, and the primary transfer roller 36 are rotatably provided and rotate when being driven by the travel of the intermediate transfer belt 31 due to the drive roller 33.

The primary transfer roller 36 applies a primary transfer bias (a bias of which polarity is opposite to a charging polarity of a toner) to the intermediate transfer belt 31. Accordingly, toner images formed on the respective photosensitive drums 37 are cumulatively and sequentially transferred (primary-transferred) onto the intermediate transfer belt 31 that revolves in a direction indicated by the arrow (counter-clockwise) due to driving of the drive roller 33 between the respective photosensitive drums 37 and the primary transfer roller 36.

The secondary transfer roller 32 applies a secondary transfer bias of which polarity is opposite to a toner image to a sheet of paper P. Accordingly, the toner image primary-transferred onto the intermediate transfer belt 31 is transferred onto the sheet of paper P between the secondary transfer roller 32 and the backup roller 35. As a result, a color toner image is formed as a printed image on the sheet of paper P.

An ID sensor 51 (patch density detecting section) is provided opposing an outer circumferential face of the intermediate transfer belt 31 in a vicinity of the drive roller 33. The ID sensor 51 is, for example, a specular reflection sensor that detects reflected light and is constituted by an LED light source arranged inclined by a predetermined angle with respect to a detection position on a surface of the intermediate transfer belt 31 and a phototransistor as a light receiving element. The ID sensor 51 detects a density of a toner patch formed on the intermediate transfer belt 31 by irradiating light onto the toner patch on the intermediate transfer belt 31 from the LED light source and detecting an intensity of light reflected off of the toner patch by the phototransistor. If R denotes reflectance of light outputted to the toner patch ($0 \leqq R \leqq 1$), then the density may be expressed as $$\text{Log } 10(1/R)$$

The ID sensor 51 converts a measurement result into an electrical signal and outputs the electrical signal to the control unit 110, to be described later.

The fixing section 4 applies fixing to an image transferred onto a sheet of paper P by the image forming section 3, and includes a heated roller 41 heated by an electric heating element and a pressure roller 42 which is arranged opposing the heated roller 41 and of which a circumferential surface is pressed against a circumferential surface of the heated roller 41. An image transferred onto the sheet of paper P by the secondary transfer roller 32 at the image forming section 3 is fixed onto the sheet of paper P by fixing which involves heating and pressurization applied when the sheet of paper P passes between the heated roller 41 and the pressure roller 42. The sheet of paper P after fixing is ejected to the paper ejecting section 5 by a conveying roller 6.

Figure 2:
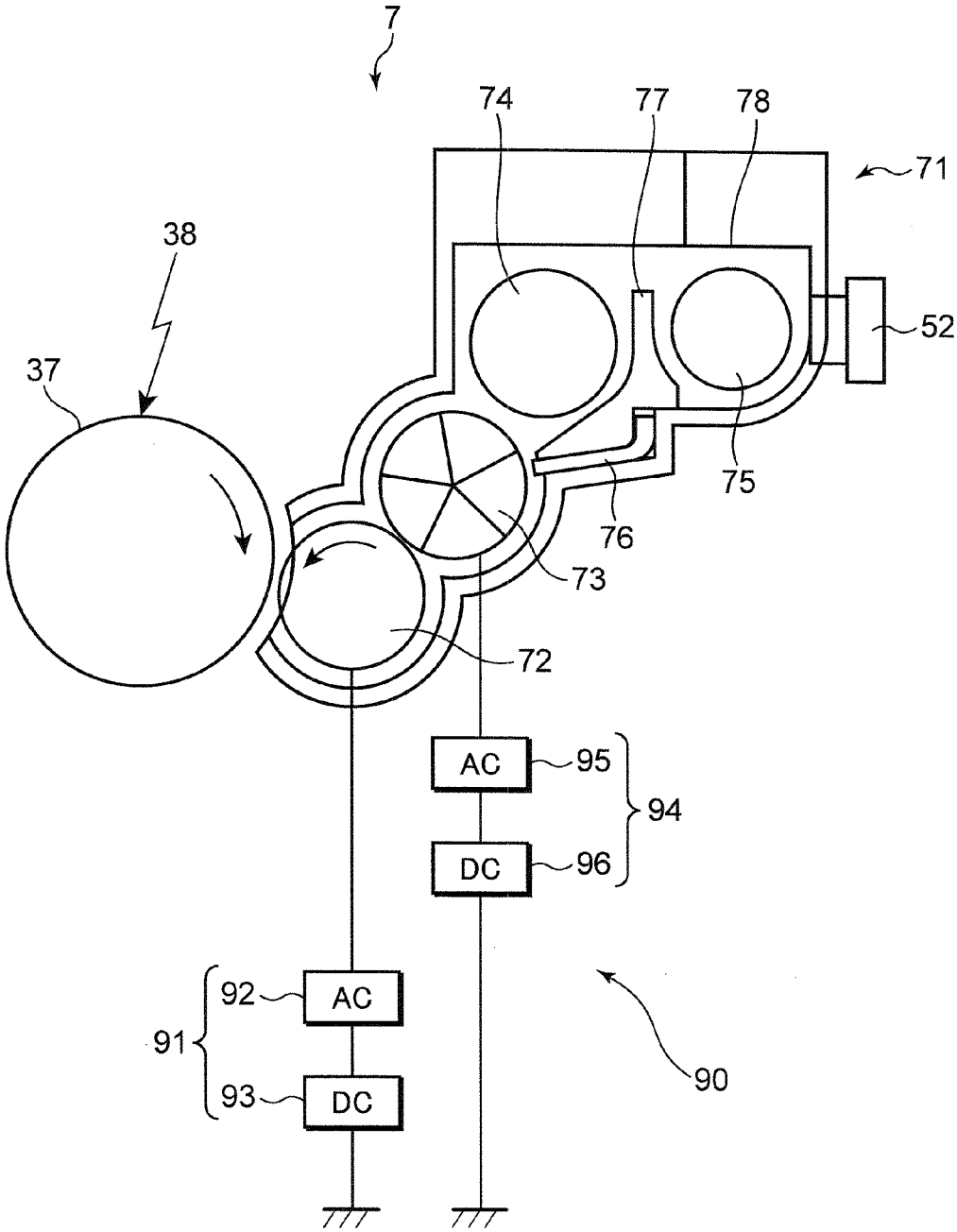
FIG. 2 is a cross-sectional view showing details of a developing device.

Next, a configuration of the developing device 71 will be described. FIG. 2 is a cross-sectional view showing details of the developing device 71. As shown in FIG. 2, the developing device 71 includes a developing roller 72, a magnet roller 73, a paddle mixer 74 (toner agitating mechanism), a agitating mixer 75 (toner agitating mechanism), a doctor blade 76, a divider 77, and a voltage applying section 90.

The developing roller 72 conveys the toner by carrying the toner on a surface of the developing roller 72. The toner carried on the surface of the developing roller 72 is supplied to the photosensitive drum 37 and an electrostatic latent image formed in advance on a surface of the photosensitive drum 37 is visualized (developed) as a toner image. The magnet roller 73 carries, on a surface thereof, a two-component developer including a toner and a carrier. A magnet is fixedly arranged inside the magnet roller 73. The two-component developer is adsorbed on a circumferential surface of the magnet roller 73 by a magnetic force of the magnet to form a magnetic brush. Moreover, among the developer carried by the magnet roller 73, only the toner is supplied to the developing roller 72.

The paddle mixer 74 and the agitating mixer 75 are elongated rotating bodies respectively having helical blades and, by rotating, agitate the two-component developer in the developer housing section 78 while conveying the two-component developer toward the magnet roller 73 to charge the toner. In addition, the paddle mixer 74 supplies the two-component developer to the magnet roller 73. Moreover, the developing roller 72, the magnet roller 73, the paddle mixer 74, and the agitating mixer 75 are driven by a drive motor 131 to be described later.

The doctor blade 76 regulates a thickness of the magnetic brush formed on the magnet roller 73. The divider 77 is an elongated plate body provided between the paddle mixer 74 and the agitating mixer 75. Moreover, the developer housing section 78 is configured to enable free passage of the two-component developer between a housing space of the paddle mixer 74 and a housing space of the agitating mixer 75 on outer sides of both ends of the divider 77.

The voltage applying section 90 includes a plurality of power sources that applies voltage, to be described later, to the developing roller 72 and the magnet roller 73. In addition, the voltage applying section 90 includes a developing bias voltage applying section 91 that generates a voltage to be applied to the developing roller 72 as a developing bias voltage and a toner supplying bias voltage applying section 94 that generates a voltage to be applied to the magnet roller 73 as a toner supplying bias voltage.

The developing bias voltage applying section 91 includes an alternating-current source 92 that generates an alternating-current voltage having a rectangular waveform and a direct-current source 93 that generates a direct-current voltage. The toner supplying bias voltage applying section 94 includes an alternating-current source 95 that generates an alternating-current voltage having a same frequency but opposite phase to the alternating-current voltage applied by the alternating-current source 92 of the developing bias voltage applying section 91, and a direct-current source 96 that generates a direct-current voltage (hereinafter referred to as a direct-current bias voltage).

Figure 3:
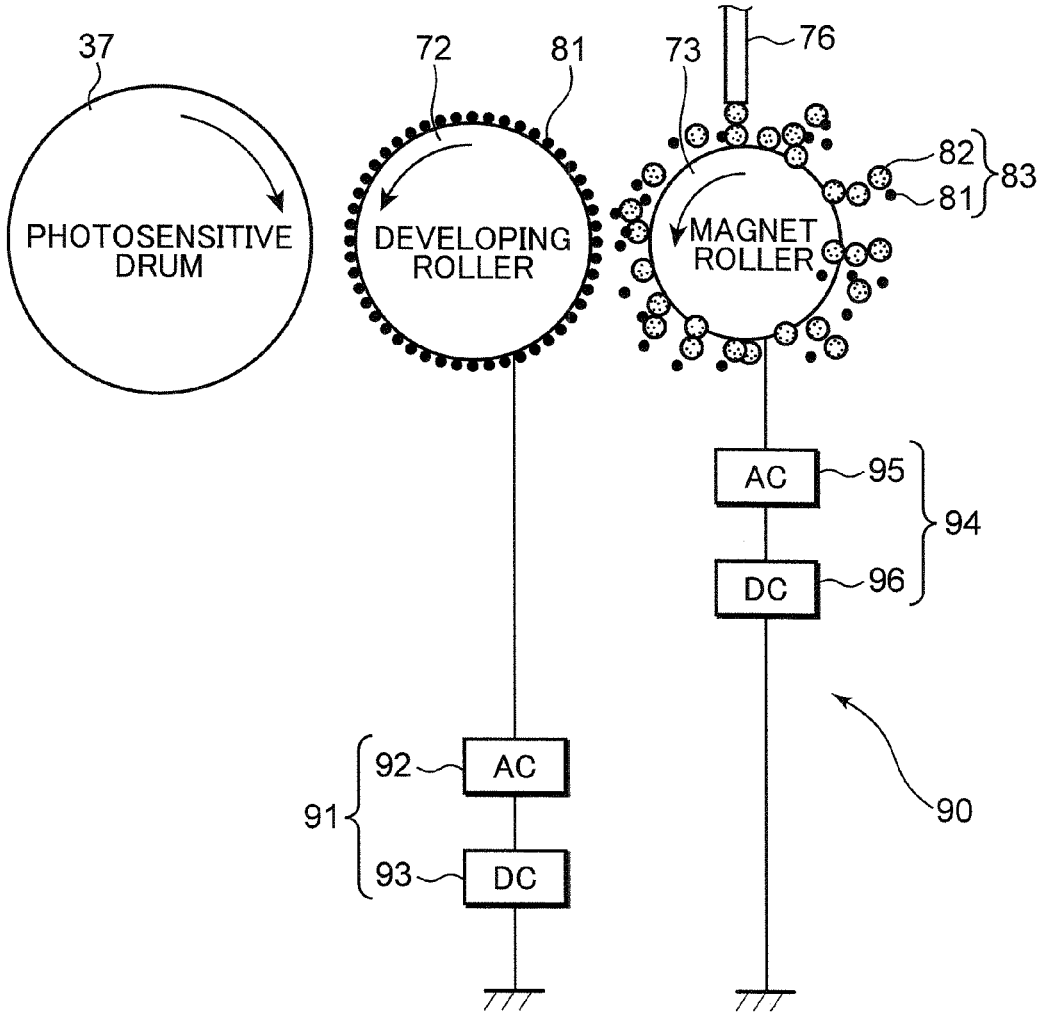
FIG. 3 is a diagram schematically showing developing operations of a developing device.

Next, developing operations of the developing device 71 will be described. FIG. 3 is a diagram schematically showing developing operations of the developing device 71. Moreover, for the sake of better visibility of the diagram, a positional relationship among the photosensitive drum 37, the developing roller 72, the magnet roller 73, and the doctor blade 76 has been altered from the positional relationship shown in FIG. 2.

A two-component developer 83 charged by rotating operations of the paddle mixer 74 and the agitating mixer 75 is supplied to the magnet roller 73. The two-component developer 83 supplied to the magnet roller 73 forms a magnetic brush on a circumferential surface of the magnet roller 73 due to a magnet inside the magnet roller 73. Subsequently, the magnetic brush moves due to a rotation of the magnet roller 73 and a thickness of the magnetic brush is regulated when the magnetic brush passes between the doctor blade 76 and the magnet roller 73.

Voltage applied by the voltage applying section 90 generates a potential difference between the developing roller 72 and the magnet roller 73. As the thickness-regulated magnetic brush moves to a vicinity of the developing roller 72, the potential difference causes only a charged toner 81 among the two-component developer 83 including the toner 81 and a carrier 82 to move to the developing roller 72.

In addition, the voltage applied by the voltage applying section 90 also generates a potential difference between the photosensitive drum 37 and the developing roller 72. Therefore, due to the potential difference, the toner 81 adhered to a surface of the developing roller 72 moves toward a surface of the photosensitive drum 37. Accordingly, an electrostatic latent image formed on the surface of the photosensitive drum 37 is visualized by the toner 81.

Figure 4A:
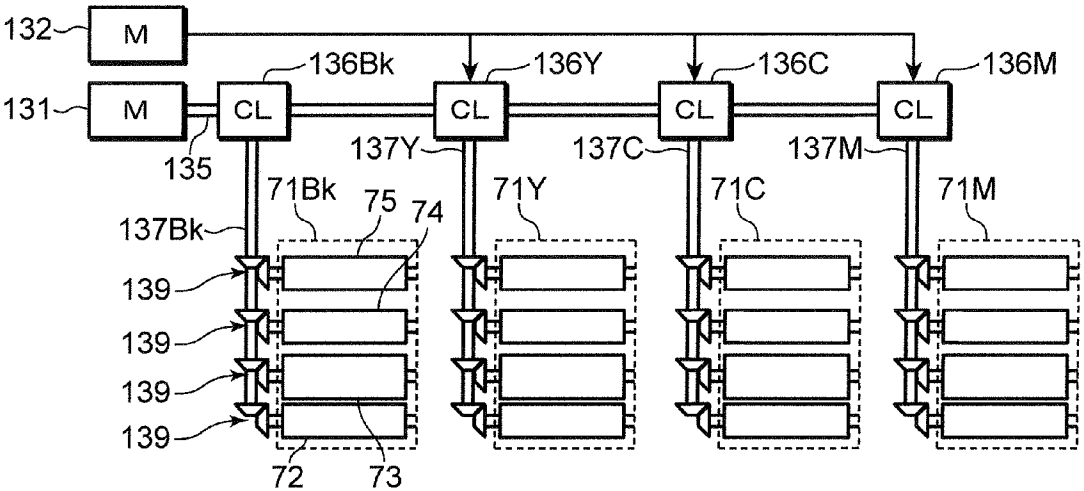
Figure 4B:
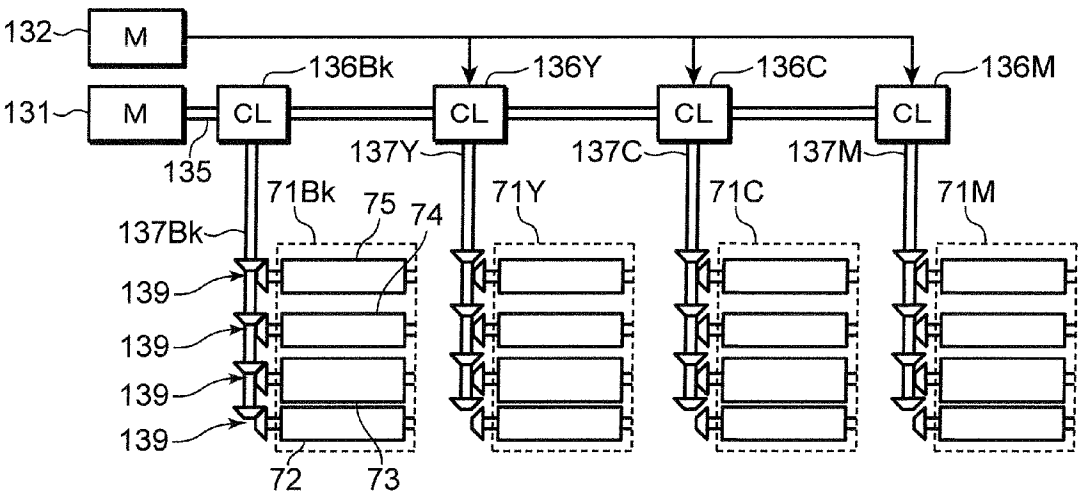

FIGS. 4A and 4B are schematic views for explaining coupling/separating of the developing device 71 to/from the drive motor 131, wherein FIG. 4A shows a coupled state and FIG. 4B shows a separated state. In order to prevent deterioration of the developing device 71 caused by driving the developing device 71 when not involved in image formation and deterioration of the toner caused by unnecessary agitating of the toner, the color printer 1 is configured so that color developing devices 71M, 71C, and 71Y are coupled to the drive motor 131 to be driven only during color mode and separated from the drive motor 131 to be stopped during black and white mode.

The drive motor 131 becomes a drive source that drives (rotates) driven bodies respectively provided in the developing devices 71M, 71C, 71Y, and 71Bk corresponding to the respective colors of MCYBk or, in other words, the developing roller 72, the magnet roller 73, the paddle mixer 74, and the agitating mixer 75 in the present embodiment. A rotative force of the drive motor 131 is transmitted to a drive shaft 135. The rotative force of the drive motor transmitted to the drive shaft 135 is transmitted to drive shafts 137M, 137C, 137Y, and 137Bk provided to correspond to each developing device 71 via clutches 136M, 136C, 136Y, and 136Bk (driving force transmission mechanisms) provided to correspond to each developing device 71, and further transmitted to the developing roller 72, the magnet roller 73, the paddle mixer 74, and the agitating mixer 75 by a power transmission gear 139 (driving force transmission mechanism).

A separation motor 132 rotates in both forward and reverse directions due to a drive pulse outputted from a separation motor controller 113, to be described later, to couple/separate the clutches 136M, 136C, and 136Y corresponding to the color developing devices 71M, 71C, and 71Y to/from the drive shafts 137M, 137C, and 137Y. In other words, in color mode, the separation motor 132 respectively couples the clutches 136M, 136C, and 136Y to the drive shafts 137M, 137C, and 137Y and drives the developing roller 72, the magnet roller 73, the paddle mixer 74, and the agitating mixer 75 of the developing device 71 (a coupled state of the developing device 71). On the other hand, in black and white mode, the separation motor 132 rotates in an opposite direction to the color mode and respectively separates the clutches 136M, 136C, and 136Y from the drive shafts 137M, 137C, and 137Y, and stops the developing roller 72, the magnet roller 73, the paddle mixer 74, and the agitating mixer 75 of the developing device 71 (a separated state of the developing device 71). In FIG. 4B, the separated states of the developing devices 71M, 71C, and 71Y are schematically expressed by a rotative force of the drive motor 131 not being transmitted to the developing roller 72, the magnet roller 73, the paddle mixer 74, and the agitating mixer 75 by the power transmission gear 139.

Figure 5:
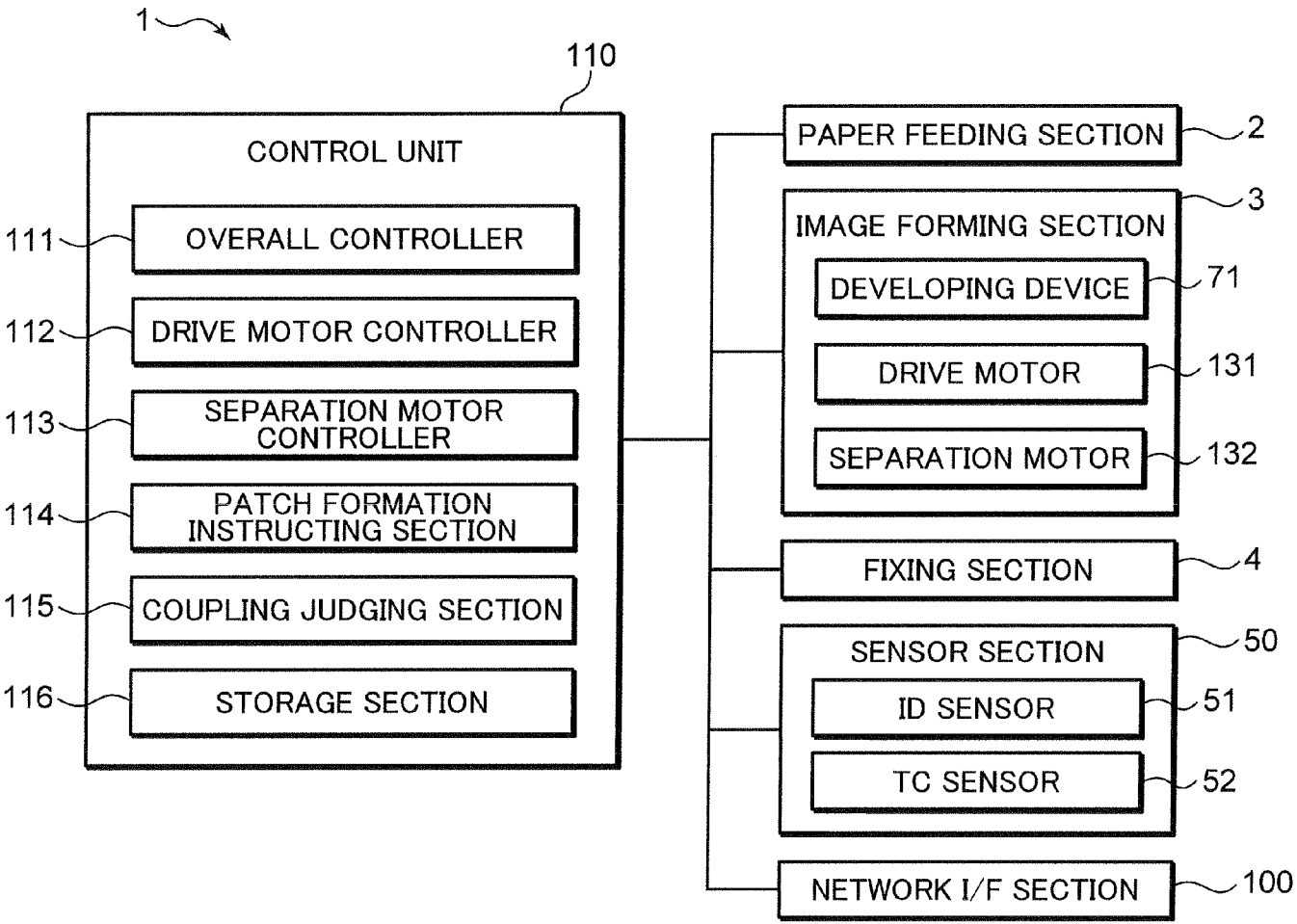
FIG. 5 is a functional block diagram showing an electrical configuration of an image forming apparatus.

FIG. 5 is a functional block diagram showing an electrical configuration of the color printer 1. As shown in FIG. 5, the color printer 1 is configured to include the image forming section 3, the paper feeding section 2, the fixing section 4, a network I/F section 100, a sensor section 50, and the control unit 110. Like components to those described with reference to FIG. 1 are denoted by like reference characters and a detailed description thereof is omitted.

The network I/F section 100 controls transmission and reception of various data among information processing devices (external devices) such as PCs connected via a network such as a LAN. The sensor section 50 includes the ID sensor 51 and the TC sensor 52 described earlier.

The control unit 110 is made up by a storage section 116 that includes a RAM (Random Access Memory) having a function for temporarily storing data and a work area function, a flash memory that stores programs in advance, and the like, and a CPU (central processing unit) that reads out a program or the like from the flash memory and executes the same. By appropriately executing a program stored in the flash memory, the CPU executes processing according to contents of the program and functions as an overall controller 111, a drive motor controller 112, a separation motor controller 113, a patch formation instructing section 114, and a coupling judging section 115.

According to an instruction signal or the like inputted from the external device connected via the network I/F section 100, the overall controller 111 reads out a program stored in the storage section 116 and executes processing, and outputs instruction signals, transmits data, and the like to the respective function sections to control the entire color printer 1.

The drive motor controller 112 outputs a predetermined drive pulse to the drive motor 131 and controls the drive motor 131 to rotate at a predetermined rotating speed. Accordingly, the developing roller 72, the magnet roller 73, the paddle mixer 74, and the agitating mixer 75 of the developing device 71 rotate at a rotating speed in accordance with the rotating speed of the drive motor 131 and a gear ratio of the power transmission gear 139.

The separation motor controller 113 outputs a predetermined drive pulse to the separation motor 132 to rotate the separation motor 132 during the color mode in a direction that causes the clutches 136M, 136C, and 136Y to respectively couple with the drive shafts 137M, 137C, and 137Y, and to rotate the separation motor 132 during the black and white mode in a direction that causes the clutches 136M, 136C, and 136Y to respectively separate from the drive shafts 137M, 137C, and 137Y.

The patch formation instructing section 114 outputs a control signal to the image forming section 3 and causes a toner patch to be formed on the intermediate transfer belt 31.

The coupling judging section 115 judges whether the color developing devices 71M, 71C, and 71Y are in a coupled state or a separated state. The judgment by the coupling judging section 115 will now be described with reference to FIG. 6.

Figure 6:
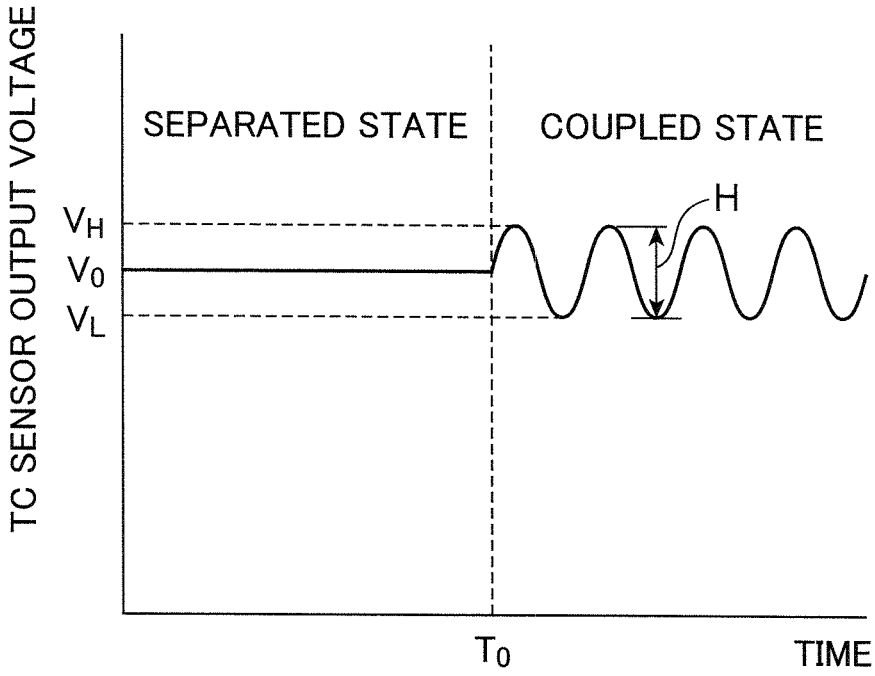
FIG. 6 is a diagram showing a variation of an output voltage value of a TC sensor (permeability sensor) in a separated state and a coupled state of a developing device.

FIG. 6 is a diagram showing a variation of an output voltage value of the TC sensor 52 in a separated state and a coupled state of the developing device 71. FIG. 6 shows a case where the developing device 71 is switched from a separated state to a coupled state at time $T_0$.

In black and white mode, the separation motor controller 113 controls the separation motor 132 to rotate in a rotating direction that causes the color developing devices 71M, 71C, and 71Y to separate from the drive motor 131. Therefore, the developing devices 71M, 71C, and 71Y enter a separated state shown in FIG. 4B and driving of the paddle mixer 74 and the agitating mixer 75 is stopped. As a result, since volume occupancy of the carrier among the developer becomes constant and permeability also becomes constant, the TC sensor 52 outputs a constant output voltage value V0.

On the other hand, in color mode, since the separation motor controller 113 controls the separation motor 132 to rotate in a rotating direction that causes the color developing devices 71M, 71C, and 71Y to couple with the drive motor 131, the developing devices 71M, 71C, and 71Y enter a coupled state shown in FIG. 4A. Therefore, the toner and the carrier are stirred in the developer housing section 78 and, as a result, the volume occupancy of the carrier in the developer fluctuates and permeability also fluctuates. Accordingly, the TC sensor 52 outputs an output voltage value having a wave height H (=VH−VL) with a maximum value of VH and a minimum value of VL.

The coupling judging section 115 judges whether a current state is the coupled state or the separated state based on such a variation in the output voltage of the TC sensor 52. More specifically, the coupling judging section 115 judges that the coupled state exists when a difference H (an example of a variation) between the maximum value VH and the minimum value VL of the output voltage value (signal value) outputted by the TC sensor is equal to or greater than a predetermined value Th1, and judges that the separated state exists when the difference is smaller than Th1. Moreover, the value Th1 is stored in the storage section 116 in advance.

In addition, since the developing device 71 is not driven in the separated state, a toner image is not formed on the photosensitive drum 37. Accordingly, a toner patch is not formed on the intermediate transfer belt 31. A toner patch is only formed on the intermediate transfer belt 31 in the coupled state.

Therefore, when judging a coupled state, the coupling judging section 115 also refers to a density of the toner patch detected by the ID sensor 51. Specifically, the coupling judging section 115 judges that the coupled state exists when a difference between the maximum value VH and the minimum value VL of the output voltage value (signal value) outputted by the TC sensor 52 is equal to or greater than the predetermined value Th1 and, at the same time, when a density of the toner patch detected by the ID sensor 51 is equal to or greater than a predetermined density Th2. As a result, the coupled state can be judged in a more reliable manner. Moreover, the value Th2 is stored in the storage section 116 in advance in the same manner as the value Th1.

Figure 7:
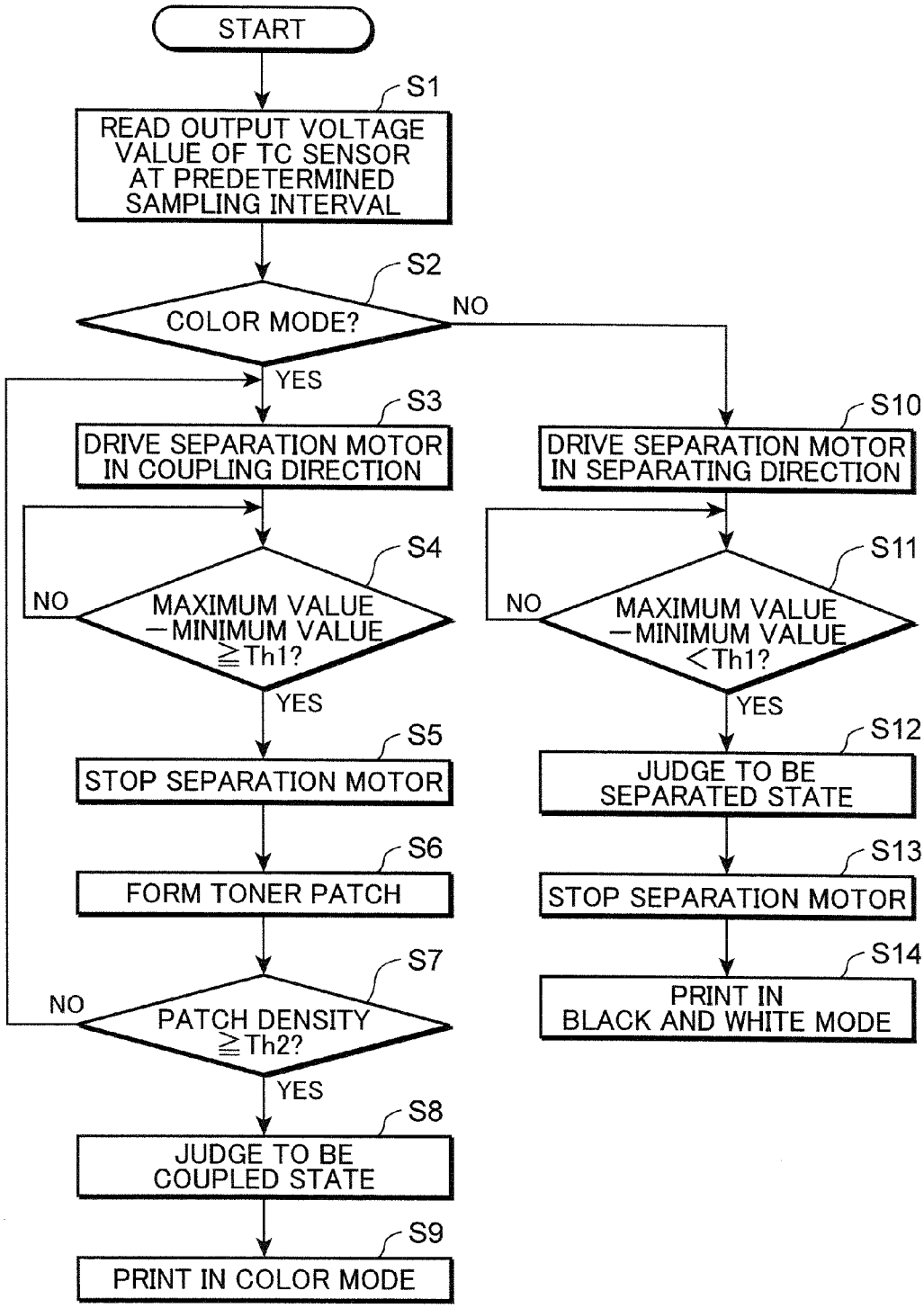
FIG. 7 is a flow chart showing operations during image formation.

FIG. 7 is a flow chart showing operations of the color printer 1 during image formation. Upon start of image formation, the coupling judging section 115 reads an output voltage value of the TC sensor 52 at a predetermined sampling interval (step S1). In color mode (YES in step S2), the separation motor controller 113 rotationally drives the separation motor 132 in a rotating direction that couples the color developing devices 71M, 71C, and 71Y to the drive motor 131 (step S3). At this point, the coupling judging section 115 calculates a difference between a maximum value and a minimum value of the output voltage value of the TC sensor 52, and when the difference is equal to or greater than a predetermined value Th1 (YES in step S4), the separation motor controller 113 stops driving of the separation motor (step S5). Subsequently, the patch formation instructing section 114 outputs a control signal to the image forming section 3 and causes a toner patch of at least one color among MCY to be formed on the intermediate transfer belt 31 (step S6).

The coupling judging section 115 compares a density of the toner patch detected by the ID sensor 51 with a predetermined value Th2 (step S7), and when the density is equal to or greater than the value Th2 (YES in step S7), judges that the color developing devices 71M, 71C, and 71Y are in a coupled state (step S8). Based on this judgment result, the overall controller 111 causes the image forming section 3 to start printing in color mode (step S9). Moreover, when the density of the toner patch detected by the ID sensor 51 is lower than the value Th2 (NO in step S7), the operation returns to step S3.

On the other hand, in black and white mode (NO in step S2), the separation motor controller 113 rotationally drives the separation motor 132 in a rotating direction that separates the color developing devices 71M, 71C, and 71Y from the drive motor 131 (step S10). At this point, the coupling judging section 115 calculates a difference between a maximum value and a minimum value of the output voltage value of the TC sensor 52, and when the difference is smaller than a predetermined value Th1 (YES in step S11), the coupling judging section 115 judges that the separated state exists (step S12) and the separation motor controller 113 stops driving of the separation motor (step S13). Subsequently, the overall controller 111 causes the image forming section 3 to start printing in black and white mode (step S14).

Figure 8:
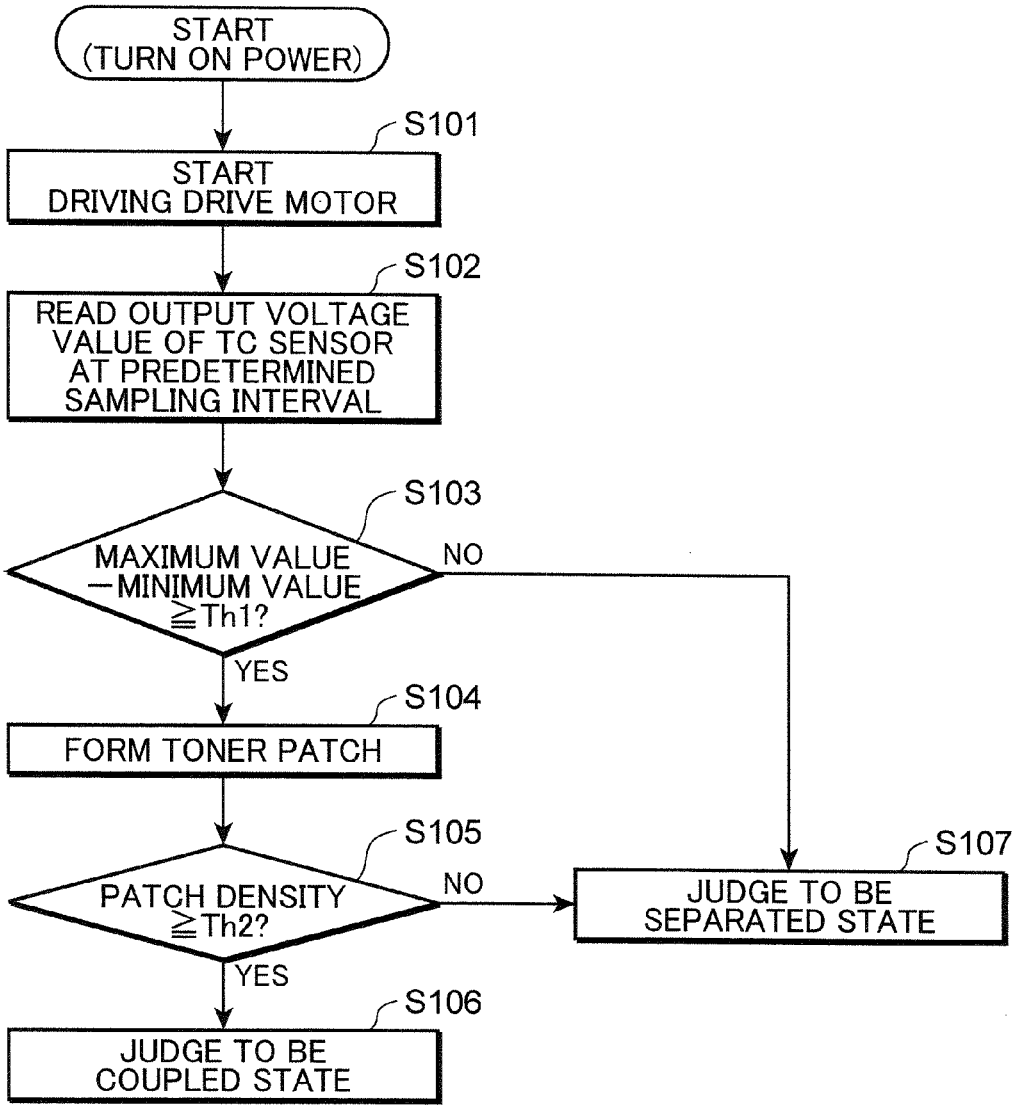
FIG. 8 is a flowchart showing operations upon power activation.

The color printer 1 does not include a position sensor for detecting positions of the clutches 136M, 136C, and 136Y or the power transmission gear 139. Therefore, upon power activation, by having the drive motor controller 112 drive the drive motor 131 and having the coupling judging section 115 perform the judgment described above, a judgment can be made regarding whether the color developing devices 71M, 71C, and 71Y are in the separated state or the coupled state. FIG. 8 is a flow chart showing the judgment by the coupling judging section 115 upon power activation.

When the color printer 1 is turned on, the drive motor controller 112 starts driving of the drive motor 131 (step S101). Subsequently, the coupling judging section 115 reads an output voltage value of the TC sensor 52 at a predetermined sampling interval (step S102) and calculates a difference between a maximum value and a minimum value of the output voltage value of the TC sensor 52 (step S103). When the difference is equal to or greater than a value Th1 (YES in step S103), the patch formation instructing section 114 outputs a control signal to the image forming section 3 and causes a toner patch of at least one color among MCY to be formed on the intermediate transfer belt 31 (step S104).

The coupling judging section 115 compares a density of the toner patch detected by the ID sensor 51 with a predetermined value Th2 (step S105), and when the density is equal to or greater than the value Th2 (YES in step S105), judges that the color developing devices 71M, 71C, and 71Y are in a coupled state (step S106).

On the other hand, when the difference between the maximum value and the minimum value of the output voltage value of the TC sensor 52 is smaller than the value Th1 (NO in step S103) or the density of the toner patch detected by the ID sensor 51 is lower than the value Th2 (NO in step S105), the coupling judging section 115 judges that the color developing devices 71M, 71C, and 71Y are in a separated state (step S107).

According to the embodiment described above, coupling and separation of the developing device 71 to the drive motor 131 can be judged without having to provide a position sensor for detecting positions of the clutches 136M, 136C, and 136Y or the power transmission gear 139. As a result, the position sensor can be eliminated and reductions in space and cost can be achieved.

In the embodiment described above (FIGS. 7 and 8), the coupling judging section 115 judges that the color developing devices 71M, 71C, and 71Y are in the coupled state when a difference between a maximum value and a minimum value of an output voltage value of the TC sensor 52 is calculated and the difference is equal to or greater than a predetermined value Th1 or when a density of the toner patch detected by the ID sensor 51 is compared with a predetermined value Th2 and the density is equal to or greater than the predetermined value Th2. Alternatively, the color developing devices 71M, 71C, and 71Y may be judged to be in the coupled state by calculating a difference between a maximum value and a minimum value of an output voltage value of the TC sensor 52 and based solely on a case where the difference is equal to or greater than a predetermined value Th1.

In addition, the coupled state of the color developing devices 71M, 71C, and 71Y may be judged by comparing a variation of the output voltage value of the TC sensor 52 with the predetermined value Th1.

While a color printer 1 has been described above as an example of an image forming apparatus according to an embodiment of the present invention, the embodiment is merely illustrative and is not intended to restrict the present invention, and various changes and modifications may be made without departing from the spirit of the invention. For example, when the separation motor controller 113 is in the process of driving the separation motor 132 and switching between the coupled state and the separated state at a point where a user turns off a power switch (corresponding to steps S3 to S5 in FIG. 7 or steps S10 to S13 in FIG. 7), the coupling judging section 115 may judge that a coupled state or a separated state exists, and after the separation motor controller 113 stops the separation motor 132, the overall controller 111 may shut down power of the color printer 1.

Moreover, the specific embodiment described above primarily includes an invention having the following configuration.

An image forming apparatus according to an aspect of the present invention includes: a plurality of photoreceptor members; a two-component system developing device which is provided to correspond to each of the plurality of photoreceptor members, internally houses a developer including a toner and a carrier, and supplies the toner to a surface of the photoreceptor member to form a toner image; a drive motor which generates a driving force; a driving force transmission mechanism which transmits driving force of the drive motor to each developing device and assumes a coupled state in which the driving force transmission mechanism is coupled to the developing device and transmits driving force of the drive motor to the developing device and a separated state in which the driving force transmission mechanism is separated from the developing device and does not transmit the driving force of the drive motor to the developing device; a toner agitating mechanism which is driven by the driving force of the drive motor when the driving force transmission mechanism is in the coupled state and which agitates the toner inside the developing device; a permeability sensor which detects permeability inside the developing device and outputs a signal according to a ratio of the toner to the carrier; and a coupling judging section which judges that the coupling state exists when a variation of a signal value outputted by the permeability sensor equals or exceeds a predetermined value and judges that the separated state exists when the variation of the signal value outputted by the permeability sensor is lower than the predetermined value.

According to the configuration described above, since the coupling judging section judges that the coupling state exists when a variation of a signal value outputted by the permeability sensor equals or exceeds a predetermined value and judges that the separated state exists when the variation of the signal value outputted by the permeability sensor is lower than the value, coupling and separation of the developing device to the drive motor can be judged without having to provide a position sensor.

In other words, a two-component system developing device normally includes the permeability sensor for detecting a ratio of a toner to a carrier. In a state where the toner agitating mechanism is coupled to the drive motor, the toner is agitated, a volume occupancy of the carrier among the developer fluctuates, and permeability also fluctuates. Therefore, a signal value outputted from the permeability sensor also fluctuates. In a state where the toner agitating mechanism is separated from the drive motor, since the toner is not agitated and the volume occupancy of the carrier among the developer and permeability are constant, the signal value outputted from the permeability sensor becomes a constant value. As described, since coupling and separation of the developing device to the drive motor can be judged using a permeability sensor that is normally included in an image forming apparatus, the position sensor can be eliminated and reductions in space and cost can be achieved.

The configuration described above may further include: an intermediate transfer belt onto which the toner image formed on the photoreceptor is transferred; an image forming section which includes the photoreceptor member and the developing device and causes a toner patch to be formed on the intermediate transfer belt; and a patch density detecting section which detects a density of the toner patch formed on a surface of the intermediate transfer belt, wherein the coupling judgment section may judge that the coupling state exists when the variation of the signal value outputted by the permeability sensor equals or exceeds the predetermined value and, at the same time, the density of the toner patch detected by the patch density detecting section equals or exceeds a predetermined density.

According to this configuration, the coupled state can be judged in a more reliable manner. This is due to the fact that, in the separated state, the developing device is not driven and a toner image is not formed on the photoreceptor. Therefore, a toner patch is not formed on the intermediate transfer belt, and a toner patch is only formed on the intermediate transfer belt in the coupled state.

In the configuration described above, the variation of the signal value is favorably a difference between a maximum value and a minimum value of the signal value outputted by the permeability sensor. According to this configuration, the coupled state can be judged relatively easily and with high accuracy.

The configuration described above favorably further includes a drive motor controller that controls the drive motor, wherein upon power activation of the image forming apparatus, the drive motor controller drives the drive motor, and the coupling judgment section judges whether the state of the driving force transmission mechanism is the coupled state or the separated state.

According to this configuration, upon power activation, the drive motor controller judges between the coupled state or the separated state. Therefore, even when a position sensor is not provided, a judgment can be made upon power activation regarding whether the state of the driving force transmission mechanism is the coupled state or the separated state.

As described above, according to the present invention, coupling and separation of a developing device to a drive motor can be judged without having to provide a position sensor. As a result, the position sensor can be eliminated and reductions in space and cost can be achieved.

This application is based on Japanese Patent application No. 2010-171991 filed in Japan Patent Office on Jul. 30, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image forming section including a plurality of photoreceptor members and two-component system developing devices which correspond respectively to each of the plurality of photoreceptor members, each of the developing devices internally houses a developer including a toner and a carrier, and supplies the toner to a surface of the respective photoreceptor member to form a toner image;

an intermediate transfer belt onto which the toner images formed on the photoreceptor members are transferred;

a patch density detecting section which detects a density of a toner patch formed on a surface of the intermediate transfer belt;

a drive motor which generates a driving force;

a driving force transmission mechanism which transmits driving force of the drive motor to each developing device and assumes a coupled state in which the driving force transmission mechanism is coupled to the developing device and transmits driving force of the drive motor to the developing device and a separated state in which the driving force transmission mechanism is separated from the developing device and does not transmit the driving force of the drive motor to the developing device;

a toner agitating mechanism which is driven by the driving force of the drive motor when the driving force transmission mechanism is in the coupled state and which agitates the toner inside the developing device;

a permeability sensor which detects permeability inside the developing device and outputs a signal according to a ratio of the toner to the carrier; and a coupling judging section which judges that the coupled state exists when a variation of a signal value outputted by the permeability sensor equals or exceeds a predetermined value and judges that the separated state exists when the variation of the signal value outputted by the permeability sensor is lower than the predetermined value, wherein the coupling judging section judges that the coupled state exists when the variation of the signal value outputted by the permeability sensor equals or exceeds the predetermined value and, at the same time, the density of the toner patch detected by the patch density detecting section equals or exceeds a predetermined density.

2. The image forming apparatus according to claim 1, wherein the variation of the signal value is a difference between a maximum value and a minimum value of the signal value outputted by the permeability sensor.

3. The image forming apparatus according to claim 1, further comprising:

a drive motor controller that controls the drive motor, wherein upon power activation of the image forming apparatus, the drive motor controller drives the drive motor, and the coupling judging section judges whether the state of the driving force transmission mechanism is the coupled state or the separated state.

* * * * *